US009415436B2

(12) United States Patent
Samuelson et al.

(10) Patent No.: US 9,415,436 B2
(45) Date of Patent: Aug. 16, 2016

(54) METHOD AND APPARATUS FOR BENDING A MICRO-CHANNEL HEAT EXCHANGER

(75) Inventors: David E. Samuelson, Wheatfield, NY (US); Kent S. Edward, Albion, NY (US)

(73) Assignee: MAHLE International GmbH, Stuttgart (DE)

( * ) Notice: Subject to any disclaimer, the term of this patent is extended or adjusted under 35 U.S.C. 154(b) by 1043 days.

(21) Appl. No.: 13/056,044

(22) PCT Filed: Aug. 5, 2009

(86) PCT No.: PCT/US2009/052801

§ 371 (c)(1), (2), (4) Date: Aug. 3, 2011

(87) PCT Pub. No.: WO2010/017269

PCT Pub. Date: Feb. 11, 2010

(65) Prior Publication Data

US 2011/0289775 A1 Dec. 1, 2011

Related U.S. Application Data

(60) Provisional application No. 61/188,439, filed on Aug. 8, 2008.

(51) Int. Cl.

| | |
|---|---|
| ***B21D 53/06*** | (2006.01) |
| ***B21D 7/022*** | (2006.01) |
| ***B21D 7/024*** | (2006.01) |
| ***B21D 53/02*** | (2006.01) |

(52) U.S. Cl.

CPC ..... *B21D 53/06* (2013.01); *B21D 7/022* (2013.01); *B21D 7/024* (2013.01); *B21D 53/02* (2013.01); *Y10T 29/4935* (2015.01)

(58) Field of Classification Search

CPC ..... B23P 15/26
USPC ..... 165/79; 29/890.03; 61/188, 439
See application file for complete search history.

(56) References Cited

U.S. PATENT DOCUMENTS 2,775,433 A * 12/1956 Matheny ..... 165/79
2,855,018 A 10/1958 Stikelleather (Continued)

FOREIGN PATENT DOCUMENTS

EP 668114 A1 * 8/1995
JP 59130630 A * 7/1984

(Continued)

OTHER PUBLICATIONS

Machine Translation of SUGIO (JP 2005 090806 A) Ret. Jun. 20, 2014 from AIPN.*

(Continued)

*Primary Examiner* — Jacob Cigna
(74) *Attorney, Agent, or Firm* — Brinks Gilson & Lione

(57) ABSTRACT

An improved corner bending apparatus and method for a bent head exchanger includes a first step of providing a tube edge clearance to at least the inner core face edges of those few tubes encompassed by the area of the core to be bent. A series of elongated braces, able to flex relative to one another, is placed into the tube edge clearance prior to bending. The braces actively maintain the tube edges (and tubes) in a parallel, undeformed orientation during the bend, which may be done by otherwise conventional apparatus.

4 Claims, 2 Drawing Sheets

(56) References Cited

U.S. PATENT DOCUMENTS

| | | | | |
|---|---|---|---|---|
| 4,744,233 | A * | 5/1988 | Trudell | 72/150 |
| 4,876,778 | A | 10/1989 | Hagihara et al. | |
| 2007/0169922 | A1 | 7/2007 | Pautler | |
| 2007/0175034 | A1 * | 8/2007 | Pan | 29/890.03 |
| 2007/0227695 | A1 | 10/2007 | Beamer et al. | |
| 2008/0202733 | A1 | 8/2008 | Samuelson et al. | |

FOREIGN PATENT DOCUMENTS

| | | | |
|---|---|---|---|
| JP | 10202334 | A * | 8/1998 |
| JP | 2005090806 | A * | 4/2005 |

OTHER PUBLICATIONS

Japanese First Office Action, JP Application No. 200980130888.8.

* cited by examiner

METHOD AND APPARATUS FOR BENDING A MICRO-CHANNEL HEAT EXCHANGER

The invention relates to a bent micro-channel heat exchanger and a method to manufacture the same. Priority is claimed to U.S. provisional application 61/188,439, filed Aug. 8, 2008.

TECHNICAL FIELD OF INVENTION

Background of Invention

Brazed aluminum heat exchangers of the type having spaced header tanks (or manifolds), flat elongated tubes corrugated air fins or centers have been a commonplace in automotive applications, where they are of a relatively small face area and installed flat, such as air conditioning condensers. It is known to bend such automotive heat exchangers into a V or U shape, as shown in U.S. Pat. No. 4,876,778, but this is a relatively simple and straighforward bend in which the tubes and fins (core face) themselves are bent, perpendicular to the tubes, not the heavier manifolds themselves, which remain straight That same U or V shaped bend of the core face can be applied to stationary air conditioning applications as well (residential heat pump, for example), but such applications often require a more difficult bending operation in which the tubes are left unbent, straight, and vertical, while the manifolds are bent into a rectangular perimeter. The vertical tubes drain condensation better, but the manifolds are heavier and more difficult to bend. Several different bending apparatuses and methods are known. A typical apparatus consists of a cylindrical solid mandrel that engages the core face, between the manifolds, and opposed flat clamps engaging the outer core face and/or manifolds, one of which is held stationary and the other of which is swung in to bend the core around the cylindrical mandrel. Another issue is the behavior of the tubes and fins at the "corners" where the manifolds are bent. These can buckle and deform, presenting at least an aesthetic objection, if not a dimunition in performance. Fins may also pull away from the tubes in the bend area, decreasing performance. This limits how tight or small a bend radius can be achieved.

Published Japanese application JP-2005090806 shows the basic bend configuration described above, and discloses some prior approaches to the bending problem. The most basic approach is to simply remove (leave out) the tubes and fins at the corners, and to cover the resulting open windows with a screen of some sort in the final installation. This has the obvious drawback of removing a considerable amount of heat exchange area out of the core face, besides necessitating the addition of some sort of screen at the corners to "fill in" the missing area and avoid disturbance of the forced air flow at the paths of least resistance. Alternate approaches proposed by JP-200509086 include removing only the fins at the bend corners, and placing the tubes more closely together in that area, and also brazing the corrugated fins to only one side of the tubes in the areas of the bend. All of these represent major changes to the way in which the basic core is stacked and brazed, and are therefore very undesirable in terms of cost and productivity.

Other methods shown in published US patent applications assigned to the assignee of the present application may be seen US2007227695 and US2008202733. The former discloses an air center of greater height that is located at the center of the bend, and which is more accommodating of the crush that occurs. The latter shows a dedicated bend spacer located in the same spot, which is designed only to act as a crush accommodater, and not as an air fin. While both systems improve the bend by accommodating or absorbing the crush, neither serves to actively control the behavior and alignment of the tubes in the area of the bend.

It is desirable to have an improved design of a heat exchanger and a method of manufacturing the improved heat exchanger that does actively control the tube alignment in the area of the bend, and so allows for easier, tighter bending without damage, and without significant change to the structure and manufacture of the basic core.

SUMMARY OF THE INVENTION

The heat exchanger design and the method of manufacturing and apparatus disclosed control and minimize the crushing of the air centers and buckling of the refrigerant tubes when the core is bent. A portion of the tube edges on the inside of the core bend is exposed by narrowing or offsetting the corrugated fins in the bend area. The tube edge offset provides room for a corresponding set of grooved vertical braces, one for each tube edge, to engage the clear portions of the tube edges. The vertical braces are fixed in the proper orientation by a flexible backing that allows them to bend from an initial flat shape on the core face into a bend radius, matching the typical cylindrical mandrel that controls the inner radius of the bend. The improved design allows a tighter radius than a conventional bend through the refrigerant tubes and centers.

BRIEF DESCRIPTION OF DRAWINGS

This invention will be further described with reference to the accompanying drawings in which.

DESCRIPTION OF INVENTION

Figure 1:
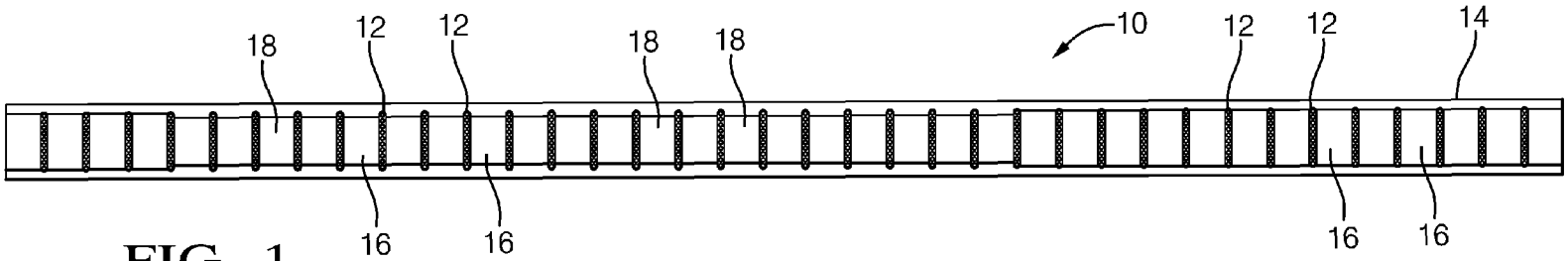
FIG. 1 is the cross sectional view, taken through the tubes and between the manifolds, of a pre bent core.

FIG. 1 shows the flat, unbent core 10, which consists of flat, parallel, regularly spaced tubes 12 extending between parallel upper and lower cylindrical manifolds 14. Only a section thereof is shown, in the area where a bend would occur, and the remainder of the core would be identical. These basic parts of the core are conventional as to size, shape and material, typically a brazable aluminum alloy. The basic core differs only as to the particular corrugated air centers or fins that are installed between the tubes 12 encompassed by and within those areas intended to be bent. Outside of the bend areas, the fins 16 are also conventional as to size, shape and installation orientation. Most significantly, those fins 16 have a width substantially equal to the depth of the tubes 12. The remaining centers 18, those installed between those tubes encompassed by the bend areas, are significantly narrower and, in this embodiment, installed centrally between the tubes 12 so as to create a tube edge to fin clearance on both faces of the core 10. This represents some change to the assembly process, requiring that the narrower centers 18 be installed just in select areas, and pushed into place with a spacer block or the like to set and maintain the tube edge clearance. However, the basic tube pitch and spacing remains the same, as would the stacker apparatus.

Figure 2:
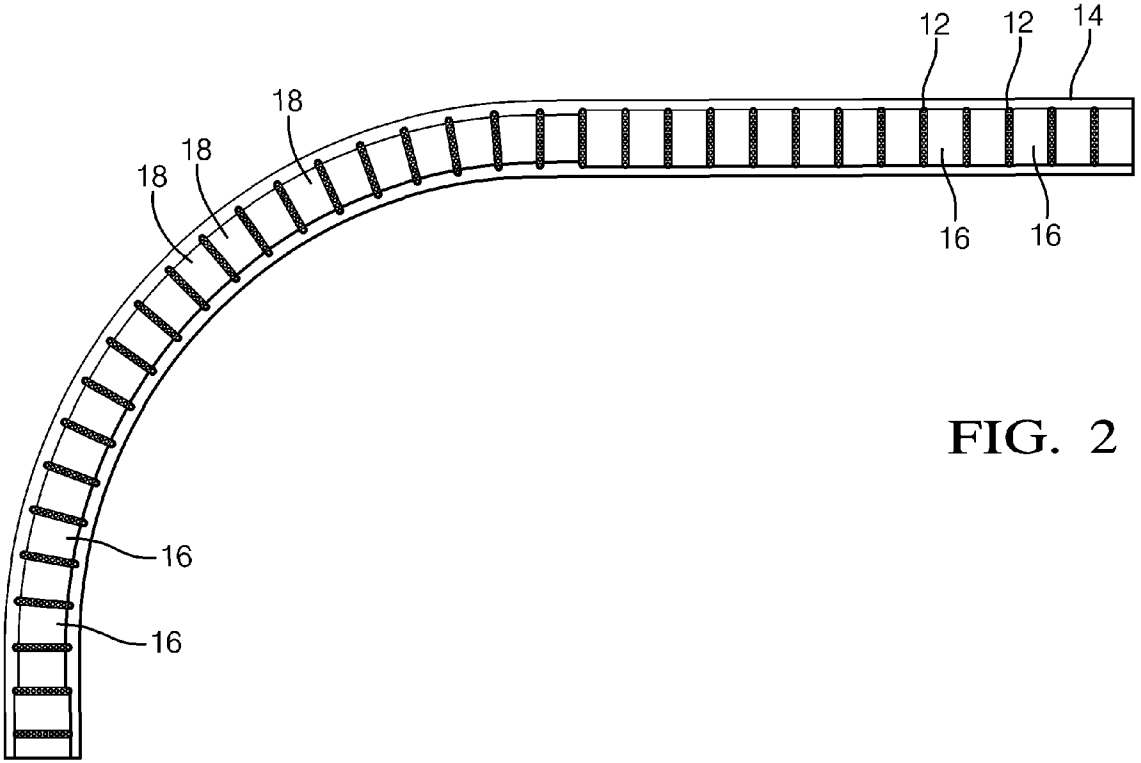
FIG. 2 is a view like FIG. 1 post bend.

FIG. 2 shows core after bending, and shows that bend is distributed only over those narrower centers 18 and the associated tubes 12, in a relatively tight radius of approximately 5 inches or less, with substantially no crush or deformation. This is accomplished by the apparatus and method described next.

Figure 3:
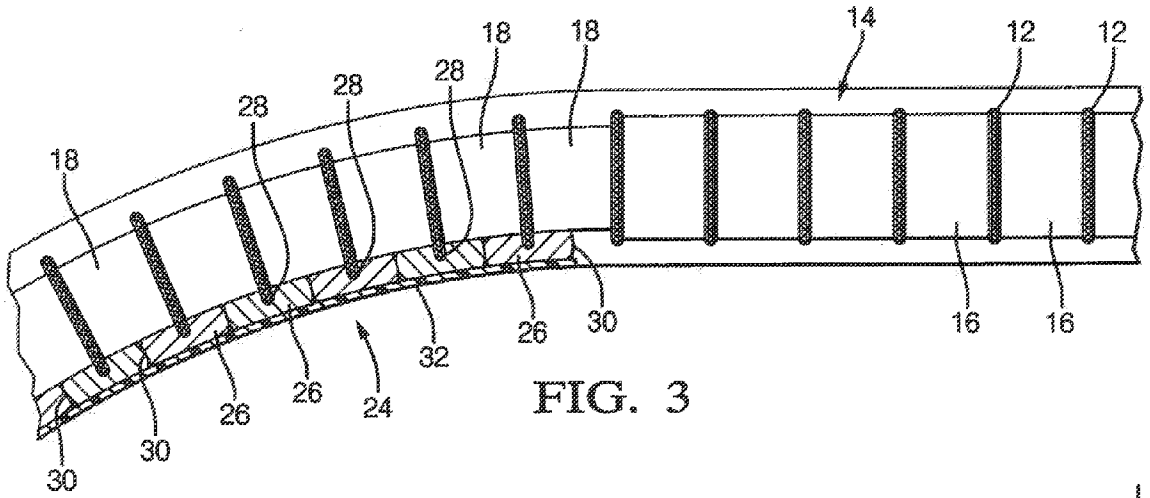
FIG. 3 is a portion of the cross sectioned core in the section to be bent, in the process of being bent, with the novel apparatus of the invention in place.

Referring next to FIG. 3, the additional and novel apparatus used in the method of the invention is indicated generally at 24. A series of solid metal braces 26, one for each tube 12 in the bend area, each consists of an elongated rail with a width approximately equal to the spacing or pitch between tubes 12, a thickness approximately equal or slightly more than clearance between the offset centers 18 and the edges of the tubes 12, and a length substantially equal to the cross manifold length of the tubes 12. Each brace 26 has a central groove 28 that closely receives the edge of a tube 12, and a rounded edge 30 that engages the rounded edge 30 of an adjacent brace 26. The braces 26 can be held together as a unitary apparatus in the edge to edge, parallel formation shown by a flexible backing 32, which could be urethane or a similar material. The set of braces 26 can then be installed as one unit onto and over the edges of the tubes 12 in the bend area, and the back face of the apparatus rests nearly flush the inner face of the rest of the core 10.

Figure 5:
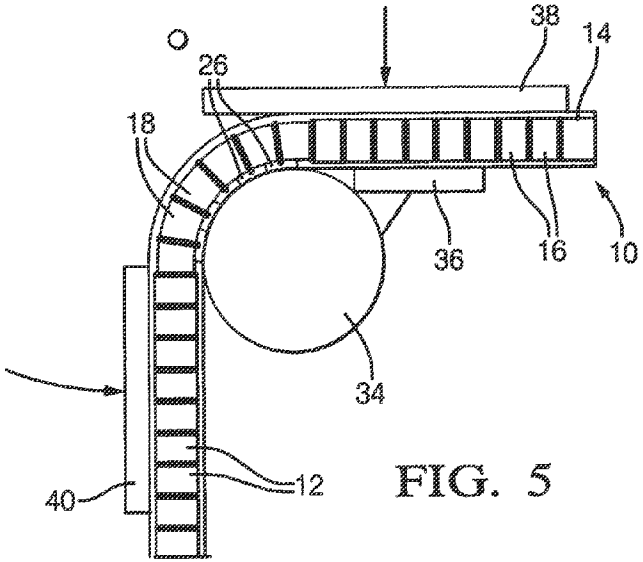
FIG. 5 is a view of the tooling in operation.
Figure 4:
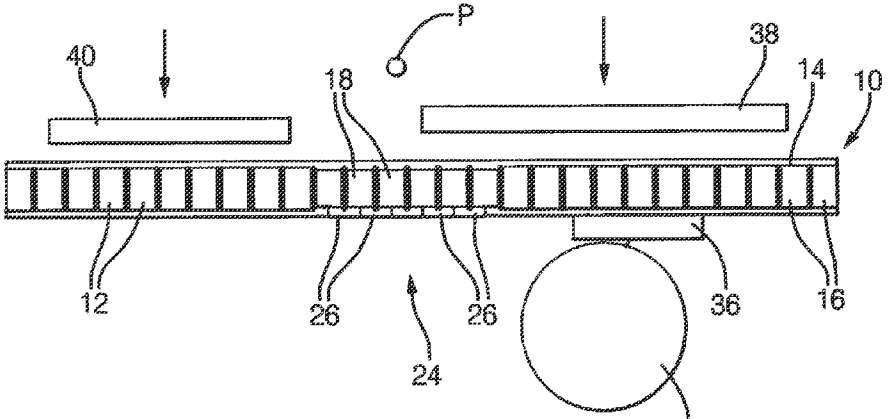
FIG. 4 is a schematic view of the core being placed in the bend tooling.

Referring next to FIGS. 4 and 5, the modified core 10, and the novel braces 26 accommodated thereby, cooperate with a conventional bending apparatus to create the improved bends. A typical bending apparatus includes a cylindrical bending mandrel 34, which has a clamp back up plate 36 fixed to one side. The core 10, with braces 26 in place on the inside of the intended bend area, is placed between and clamped closely between the mandel back up plate 36 (inner core face) and an opposed clamp 38 (outer core face) with the braces 26 oriented over the 12 to 9 o'clock quadrant of the cylindrical mandrel 34. A swinging contact plate 40 is designed to engage the outer core face on the opposite side of the bend area and to swing forcefully down, about the pivot point P shown, to approximately a vertical position. As the bending occurs, the pattern of braces 26 bends around the mandrel 34 along with the core 10, serving to actively keep the inner core face edges of the tubes 12 in the bend area aligned and undeformed. The adjacent cylindrical or rounded edges 32 roll around each other as the backing 34 flexes, allowing the grooves 28 to fan out and keep the inner edges of the tubes 12 in proper alignment. Concurrently, the outer core face edges of the same tubes 12 will fan out more evenly, by virtue of the inner edges having been maintained in alignment. While the bending apparatus and method steps (at least after the placement of the braces 26) are not significantly changed, the end result of the bent core is significantly improved, both as to the symmetry and lack of deformation and as to the tightness of the bend radius, which may be approximately 5 inches or less Alternate embodiments of the core disclosed could be used, so long as edge clearance to accommodate the braces 26 was provided. will work, since all provide the clearance for the placement of the braces 26. A narrower fin could be placed offset from the inner core face all the way to the core back face, rather than centered as show. Or, a conventional width fin could be offset from the inner core face and left to overhang the outer core face to an extent. The narrower, centered fin 18 shown may be best adapted in as well as providing a core 10 with no preferred orientation as to which face will accept the braces 26, has no fin to tube attachment near the outer edges of those tubes 12 in the bend area. Consequently, as those outer tube edges fan out, there will be less tendency of the tube to fin braze joints to tear. This also enables tighter bend radii.

While this invention has been described in terms of the preferred embodiments thereof, it is not intended to be so limited, but rather only to the extent set forth in the claims that follow. Variations possible would include the complete absence of air centers in the bend area, which can be conceptualized as the air centers becoming vanishingly narrow, in effect, providing the ultimate tube edge clearance in the bend area to accommodate braces. In that event, with the extra and in fact complete clearance, the braces could support more than just the inner core face edges of the those tubes encompassed by the bend area, and could consist potentially of something like full width rubber blocks under compression that would support the entire profile of those tubes during bending, going into further compression on the inside of the neutral axis of the bend and going into less compression on the outside of the neutral axis. Fins of some sort in the bend area are preferred, however, as they add performance and prevent path of least resistance air flow out of the corners in operation. The braces 26 could, conceivably, be placed one at a time on the tube edges, especially if the core lay horizontal the inner face up, and the mandrel could keep them in place throughout the bend. It is advantageous to hold the braces together as a unit by some sort of flexible medium, however.

We claim:

1. A method of manufacturing a bent heat exchanger core having upper and lower parallel horizontal manifolds, inner and outer core faces, a plurality of vertical flat tubes extending in parallel with each other between the manifolds, wherein each of the vertical flat tubes includes inner edges, and air fins brazed between the tubes, and at least one radiused bend area in the manifolds, comprising the steps of:

assembling the heat exchanger, prior to bending, with a clearance located at the inner core face on an inside bend of an intended bend area, wherein the clearance being a distance between the inner edges of those tubes encompassed by the area of the manifolds to be bent and the air fins installed between those tubes, providing a series of tube edge supporting braces parallel to the inside edges in the clearance on the inside bend of the intended bend area, wherein each of the braces includes a groove configured to engage respective one of the inner edges of the flat tubes and the braces being adapted to flexibly follow the intended inside bend of the manifolds while continuing to support the inner edges of the tubes such that the inner edges of the tubes are vertically maintained in parallel alignment with one another and undeformed, engaging the inner core face with a cylindrical mandrel on the inside bend of the intended area of the bend while providing a core clamping force on one side of the bend area and providing a bending force around the mandrel on the outer core face of the bend area, thereby bending the manifolds around the cylindrical mandrel while the braces maintain those tubes encompassed in the bend area in a substantially parallel and substantially undeformed vertical orientation.

2. The method according to claim 1, in which the core has narrower air fins brazed between adjacent tubes in the bend area centered on the tubes as compared to air fins brazed between adjacent tubes not in the area bend, so as to create a tube edge clearance on both the inner and the outer core faces.

3. The method according to claim 1, in which each brace consists of an elongated rail with a central groove that engages the inner edge of a tube encompassed within the bend area.

4. The method according to claim 3, in which each brace further includes a rounded edge in rolling engagement with an adjacent brace edge and a flexible backing maintaining the braces together as a unit.

* * * * *